US005456802A

United States Patent [19]

Worcester

[11] Patent Number: 5,456,802

[45] Date of Patent: Oct. 10, 1995

[54] THREADING VACUUM SHEAVE FOR A TISSUE CALENDER

[75] Inventor: Brian J. Worcester, Janesville, Wis.

[73] Assignee: Beloit Technologies, Inc., Wilmington, Del.

[21] Appl. No.: 156,132

[22] Filed: Nov. 22, 1993

[51] Int. Cl.[6] ..... D21F 7/02

[52] U.S. Cl. ..... 162/289; 162/193; 162/361; 162/368; 162/369; 162/370; 162/372; 226/7; 226/95; 226/97; 242/615.3; 242/548; 100/173; 100/174

[58] Field of Search ..... 162/361, 193, 162/289, 315, 362, 363, 364, 368, 369, 370, 372, 373; 226/7, 97, 95; 138/37, 39; 100/90, 173, 174; 242/615.3, 548

[56] References Cited

U.S. PATENT DOCUMENTS

| | | | |
|---|---|---|---|
| 1,732,833 | 10/1929 | Carpenter . | |
| 2,714,840 | 8/1955 | Bayrer et al. | 92/73 |
| 3,705,676 | 12/1972 | Overly et al. | 226/97 |
| 3,756,486 | 9/1973 | Howorth et al. | 226/97 |
| 3,853,279 | 12/1974 | Gerstein | 242/548 |
| 4,074,441 | 2/1978 | Helversen et al. | 34/122 |
| 4,324,613 | 4/1982 | Wahren | 162/111 |
| 4,759,512 | 7/1988 | Gaiser | 242/615.3 |
| 5,042,347 | 8/1991 | Baum et al. | 83/422 |

FOREIGN PATENT DOCUMENTS

| | | | |
|---|---|---|---|
| 1904101 | 1/1969 | Germany | 226/97 |

*Primary Examiner*—David L. Lacey
*Assistant Examiner*—Mark DeSimone
*Attorney, Agent, or Firm*—Dirk J. Veneman; Raymond W. Campbell; David J. Archer

[57] ABSTRACT

A vacuum/blowing sheave on the end of the lower calender roll of a papermaking machine threads a tissue web tail from a Yankee dryer to a take-up reel through the calender. The sheave is positioned adjacent to the outlet of the threader tube from the Yankee dryer, where the vacuum portion of the sheave picks up the tail and transports it towards the take-up reel. Upon transiting the closed nip of the calender, the tail is blown by a short blowing section on the sheave into the tube threader which leads to the take-up reel.

8 Claims, 1 Drawing Sheet

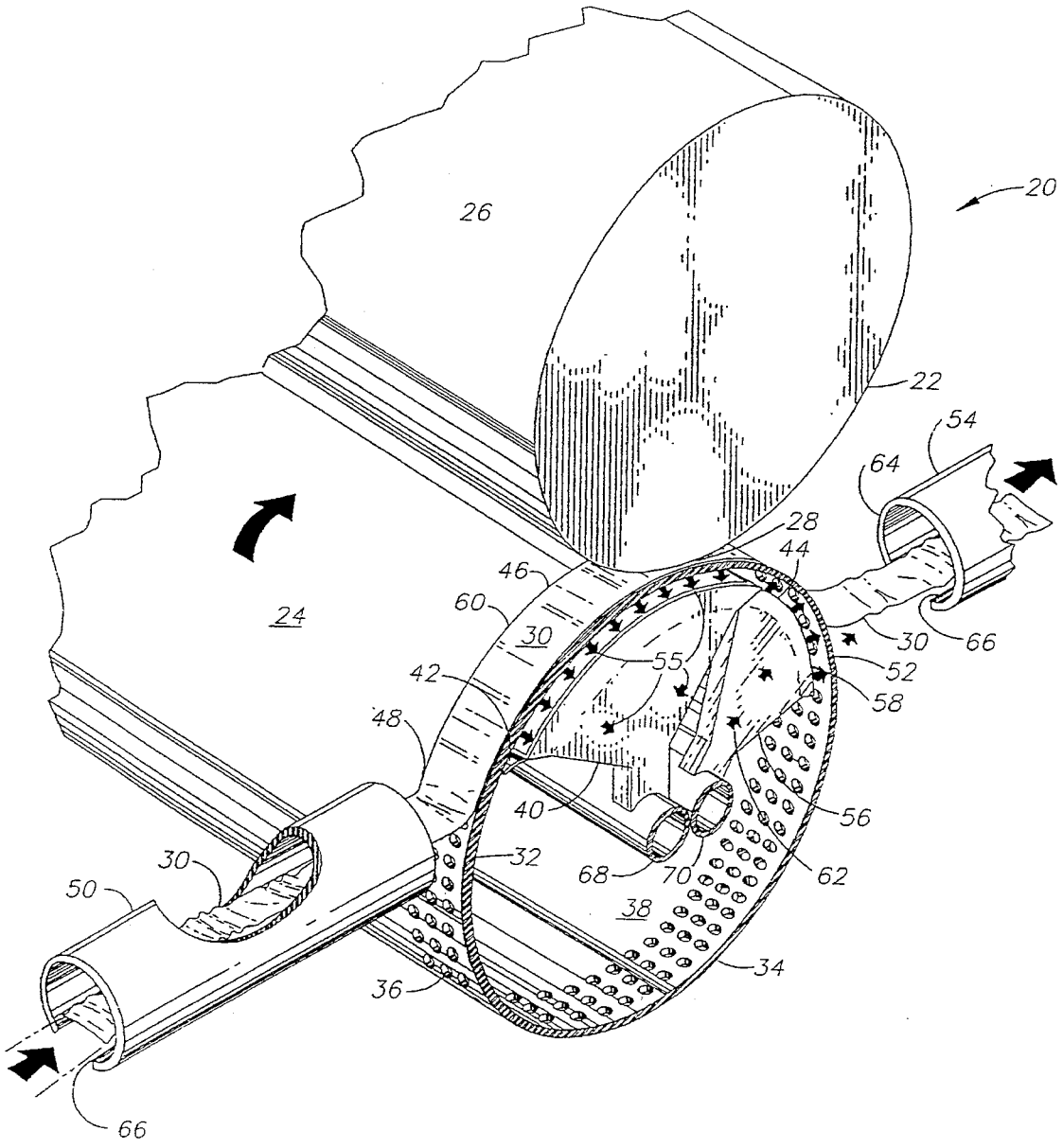
20
26
22
54
64
28
44
46
60
30
24
30
66
55
52
42
58
48
40
56
32
68
70
62
30
50
38
34
36
66

THREADING VACUUM SHEAVE FOR A TISSUE CALENDER

FIELD OF THE INVENTION

The present invention relates to apparatus for threading a paper web through a papermaking machine. More particularly, the present invention relates to apparatus for threading a tissue web in a papermaking machine.

BACKGROUND OF THE INVENTION

Light weight tissue, such as facial tissue and toilet paper, is manufactured at high speeds of four to five thousand feet per minute or more. These light weight grades of tissue are formed, pressed and dried on a Yankee dryer. On the Yankee dryer, the tissue is removed by a doctor blade which crepes the paper, giving it resiliency and absorbency, after which the tissue is fed through a two-roll calender to a take-up roll. Threading the light-weight tissue from the Yankee dryer through the calender to the take-up roll is extremely difficult. From the paper former, the tissue web is supported by felt until it is pressed onto the Yankee dryer. After it is removed from the Yankee dryer, the unsupported web must be threaded through the calender to the take-up roll.

The normal threading process involves creating a tail, which is a five-to eight-inch-wide strip taken from the edge of the paper coming off the Yankee dryer. In the known method, this tail is blown through a tube threader which directs the tail through the open nip of the calender to a second tube threader which leads to the take-up reel. A problem arises because the tail frequently fails to transit the calender roller. This simple problem in threading leads to considerable inefficiency and additional cost. When the tail is created, the Yankee dryer is supplying a tissue web two-, three-, or even four-hundred inches wide at the rate or four- or five-thousand feet per minute. All the tissue which does not form the tail must be sent to the repulper. Any failure of the tail to successfully reach the take-up roll means that, as the jam is cleared and a new tail is sent through the machine, a sheet of tissue paper several hundred inches wide will be produced at the rate of over five-thousand feet per minute and will need to be repulped.

What is needed is a system for threading a tissue web from the Yankee dryer through the calender to the take-up roll with a high reliability.

SUMMARY OF THE INVENTION

The tissue threading apparatus of this invention accomplishes the reliable threading of a tissue tail from the Yankee dryer to the take-up reel through the calender by employing a vacuum/blowing sheave on the edge of the lower calender roll. This sheave is placed adjacent to the outlet of the threader tube from the Yankee dryer, where the vacuum portion of the sheave picks up the tail and transports it toward the take-up reel. Upon transiting the closed nip of the calender, the tail is blown by a short blowing section on the sheave into the tube threader which leads to the take-up reel.

The vacuum/blowing sheave operates on the top half of a narrow end portion of the lower calender roll. A vacuum section spanning approximately one-hundred-sixty degrees of the roll is produced by an internal seal which draws vacuum through holes in the sheave formed at the end of the blower calender roll. A short section of approximately twenty degrees is created by additional seals where air is blown through holes on the sheave surface, thus lifting the tail off the roll and into the tube threader leading to the reel.

It is an object of the present invention to provide a threading system for a tissue manufacturing papermaking machine.

It is another object of the present invention to provide an apparatus for threading tissue through a closed calender.

It is a further object of the present invention to provide a tissue calender threader of improved reliability.

Further objects, features, and advantages of the invention will be apparent from the following detailed description when taken in conjunction with the accompanying drawings.

BRIEF DESCRIPTION OF THE DRAWING

The FIGURE is a somewhat schematic, partly cut-away isometric view of the tissue calender threader of this invention.

DESCRIPTION OF THE PREFERRED EMBODIMENT

Referring more particularly to the FIGURE wherein like numbers refer to similar parts, a tissue calender threader apparatus 20 is shown. A tissue calender 22 has a lower roll 24 and an upper roll 26. The lower roll 24 is opposed to and forms a nip 28 with the upper roll 26. Calendering tissue paper is an important step in the manufacture of tissue paper. Tissue paper is manufactured on a short papermaking machine. After the paper is formed and dewatered, it is pressed onto a Yankee dryer where the intimate contact between the unsupported web and the dryer's surface results in rapid drying. The tissue web is removed from the Yankee dryer, which may have a diameter of twelve or even eighteen feet, by a doctor blade which scrapes the paper from the Yankee dryer drum surface. This doctoring of the paper from the dryer surface crepes the paper, giving the tissue softness and absorbency. Normally, drying is complete after leaving the Yankee dryer, although in some circumstances the tissue will be run through several additional dryers.

From the Yankee dryer the tissue is normally unsupported and is fed to the calender 22, where the tissue web is smoothed before passing on to the take-up reel. Processing through the calender 22 facilitates the later sheeting of the tissue into products such as toilet paper, facial tissue, and paper towels.

Threading of a tissue manufacturing paper machine is complicated by the low strength of the tissue web. Threading is accomplished in a conventional method by creating a tissue tail, which is a five- to eight-inch-wide strip of tissue. The tail is created by dividing the entire web into the narrow tail and a web remainder, which is sent for repulping.

In a conventional threading process, the tail is blown between the Yankee dryer and the calender through a threading tube positioned on one side of an open calender. The tail must transit the open calender and be picked up by a threading tube leading to the take-up reel. If the tail is successively threaded, it is removed from the threading tubes and gradually widened out until the entire web passes through the calender and onto the take-up reel. Because the production of the tail requires the reprocessing of a large quantity of tissue paper, failure to complete the threading process on first try results in considerable expense. Not only is a large quantity of tissue required to be repulped and reformed, but the repulping of the tissue degrades fiber characteristics which reduces the value of the reprocessed pulp.

The threading apparatus 20 employs a vacuum/blowing sheave 32 formed at the end 34 of the lower roll 24. The sheave 32 is formed by a portion of the roll 24 which is perforated by holes 36 to render the sheave permeable to air flow therethrough. Positioned on the inside surface 38 of the roll 24 is a vacuum gland 40. The vacuum gland 40 is a fixed air duct which has wiping end seals 42, 44 which engage with the rotating roll 24, and circumferential seals (not shown) which seal the gland to a region 46 of the sheave 32 so that vacuum may be drawn through the region 46. The vacuum region extends from a position 48 facing and at approximately the same level as the threading tube 50 from the Yankee dryer to a position 52 spaced above the threader tube 54 to the take-up reel. In the figure the movement of air caused by the vacuum is shown by arrows A blowing gland 56 is positioned adjacent to and downstream of the vacuum gland 40. The blowing gland 56 is also a fixed duct connected to a separate source of blowing air which creates a blowing region extending from a location adjacent to the vacuum region 46 to a position on the roll at a level with the reel tube threader 54.

In operation, a tail 30 is blown by air jets (not shown) through a tube-threader 50 toward the vacuum region 46 of the sheave 32 on the roll 24. The vacuum gland 40 draws air through the holes 36 which causes the tail 30 to adhere to the surface 60 of the roll 24. The engaged tail 30 transits the nip 28 between the upper roll 26 and the lower roll 24, where it is conducted to a position 52 spaced from the threading tube 54. The tail 30 is then blown by air, indicated by arrows 62, which passes through the blowing gland ,56, and is thus blown away from the surface 60 of the roll 24 and into the inlet 64 of the tube threader ,54, where air jets (not shown) propel the tail 30 to the reel (not shown).

The threading apparatus 20 threads a closed calender 22. Once the calender 22 is threaded, the tail is removed from threading tubes 50, 54 through the open bottom slot 66. The tail is then widened until the entire web is fed through the calender 22.

The sheave 32 will be run only intermittently, used only when threading a start-up of a new parent roll or after a sheet break.

The suction gland 40 is supplied with negative air pressure through a manifold 68. The blowing air is supplied through a manifold 70.

It should be understood that the sheave could be mounted on the tending side or the drive side of the calender roll 22.

It should also be understood that the width of the sheave will normally be equivalent to the width of the tail, five- to eight inches, but may be somewhat more or less, depending on the tail width used in a particular machine.

It should also be understood that the positioning of the end seals 42, 44 of the suction gland can be varied with the threading tubes 50, 54 being repositioned so as to supply the tail to the vacuum portion 46 of the sheave 32 and to receive the tail, where it is blown from the roll surface 60 by the blowing region 58, which overlies the blowing gland 56.

It should be understood that the invention is not confined to the particular construction and arrangement of parts herein illustrated and described, but embraces such modified forms thereof as come within the scope of the following claims.

I claim:

1. An apparatus for threading tissue through a calender comprising:

a tissue calender having first and second rotatably driven rolls, wherein the first roll is opposed to the second roll to form a nip;

a narrow cylindrical portion of the first roll adjacent to an end of the first roll, wherein the narrow portion is perforated so air can be drawn into and blown out of the narrow portion;

a first threader tube closely spaced from and leading to the calender;

a second threader tube closely spaced from and leading away from the calender;

a suction gland inside the first roll for applying suction to a portion of the perforated portion, thus forming a vacuum portion, wherein the vacuum portion extends from a region facing the first threader tube through the nip and spaced from the portion of the roll at the level of the second threader tube, and a blowing gland inside the first roll for applying blowing to a portion of the perforated portion, thus forming a blowing portion, the blowing portion extending from the vacuum portion to a portion of the roll facing the second threader tube, wherein the vacuum portion picks up a tail from the first threader tube and transports it through the nip towards the second threader tube leading to a take-up reel, the blowing region lifting the tail off the roll and into the second threader tube leading to the reel.

2. The apparatus of claim 1 wherein the first roll is the bottom roll in a two roll calender.

3. The apparatus of claim 1 wherein the narrow cylindrical portion has a width of five to eight inches.

4. An apparatus for threading a calender comprising:

a calender having a first rotatably driven roll which is opposed to a second rotatably driven roll to form a nip;

a narrow cylindrical portion of the first roll adjacent to an end of the first roll, wherein the narrow portion is permeable so air can be drawn into and blown out of the narrow portion;

a first threader tube adjacent to and leading to the calender;

a second threader tube adjacent to and leading away from the calender;

a suction gland inside the first roll for applying suction to a portion of the permeable portion, thus forming a vacuum portion, wherein the vacuum portion extends from a region adjacent to the first threader tube through the nip and is spaced from the portion of the roll adjacent to the second threader tube; and a blowing gland inside the first roll for applying blowing to a portion of the permeable portion, thus forming a blowing portion, wherein the blowing portion extends from the vacuum portion to the portion of the roll adjacent to the second threader tube, wherein the vacuum portion picks up a tail from the first threader tube and transports it through the nip toward the second threader tube leading to a take-up reel, the blowing region lifting the tail off the roll and into the second threader tube leading to the reel.

5. The apparatus of claim 4 wherein the first roll is the bottom roll in a two roll calender.

6. The apparatus of claim 4 wherein the narrow cylindrical portion has a width of five to eight inches.

7. The apparatus of claim 4 wherein the permeability of the narrow cylindrical portion is due to a multiplicity of holes formed in the cylindrical portion.

8. An apparatus for threading a calender in a papermaking machine, the apparatus comprising:

a first rotatable cylindrical roll;

a second rotatable cylindrical roll opposed to the first roll, wherein the rolls are rotatably driven to form a calender with a nip;

portions of the first roll which define a perforated peripheral region having a plurality of openings therein through which air may pass;

a first threader tube which extends toward the first roll and which discharges a web tail toward the calender;

a second threader tube which extends away from the first roll and which receives a web tail therein for conveying the tail away from the first roll;

a first duct within the first roll which is fixed with respect to the rotating first roll, and which engages against a vacuum segment of the perforated region of the first roll;

a source of vacuum which draws air through the vacuum segment and through the first duct to engage a web tail discharged from the first threader tube against the first roll and retain it therein through the calender nip;

a second duct within the first roll which is fixed with respect to the rotating first roll and with respect to the first duct, wherein the second duct engages against a blowing segment of the perforated region which is adjacent to and downstream of the vacuum segment; and a source of forced air which blows air through the second duct and through the blowing segment to disengage a web tail from the first roll and to direct the disengaged tail into the second threader tube.

* * * * *